United States Patent [19]

Wang

[11] Patent Number: 5,004,224

[45] Date of Patent: Apr. 2, 1991

[54] STEPPING EXERCISER

[76] Inventor: Teresa Wang, 2 Fl., No. 20-1, Alley 6, Lane 670, Ta Ya Rd., Taichung, Taiwan

[21] Appl. No.: 531,565

[22] Filed: Jun. 1, 1990

[51] Int. Cl.[5] ..... A63B 23/04

[52] U.S. Cl. ..... 272/70; 272/DIG. 4

[58] Field of Search ..... 272/70, 130, 71, 73, 272/96, 97, 135, 69

[56] References Cited

U.S. PATENT DOCUMENTS 4,830,362 5/1989 Ball ..... 272/70

4,832,332 5/1989 Dumbser ..... 272/70

4,838,543 6/1989 Armstrong et al. ..... 272/130

4,909,504 3/1990 Yang ..... 272/70

*Primary Examiner*—Stephen R. Crow

*Attorney, Agent, or Firm*—Staas & Halsey

[57] ABSTRACT

A stepping exerciser has a pair of treadles pivoted to a front end of a frame body. A rod is fixed to the front end of each treadle and extends downward. The lower ends of the rods are coupled together by a pair of link rods and a lever. A pair of cylinders are coupled between the frame body and the rods. One of the treadles is rotated upwards when the other treadle is depressed downwards by a user so that the user may simulate stepping or climbing a ladder.

1 Claim, 4 Drawing Sheets

STEPPING EXERCISER

BACKGROUND OF THE INVENTION

The present invention relates to an exercising mechanism, and more particularly to a stepping exerciser.

Various kinds of exercising mechanisms were developed, but, most of the exercising mechanisms simulate cycling exercise, such as U.S. Pat. No. 4,188,030 to Hooper; U.S. Pat. No. 3,995,491 to Wolfla, II; and U.S. Pat. No. 4,842,268 to Jenkins.

SUMMARY OF THE INVENTION

The primary objective of the present invention is to provide a stepping exerciser which simulates stepping or climbing a ladder.

In accordance with one aspect of the invention, there is provided a stepping exerciser which has a frame body. A pair of treadles are pivoted to a front end of the frame body. A handlebar is vertically coupled to the front end of each treadle and extends upward. A rod is fixed to the front end of each treadle and extends downward. The lower ends of the rods are coupled together by a pair of link rods and a lever. A middle portion of the lever is pivoted to a base of the frame body. A pair of cylinders are coupled between the frame body and the rods. One of the treadles is rotated upwards when the other treadle is depressed downwards by a user so that the user may simulate stepping or climbing a ladder.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
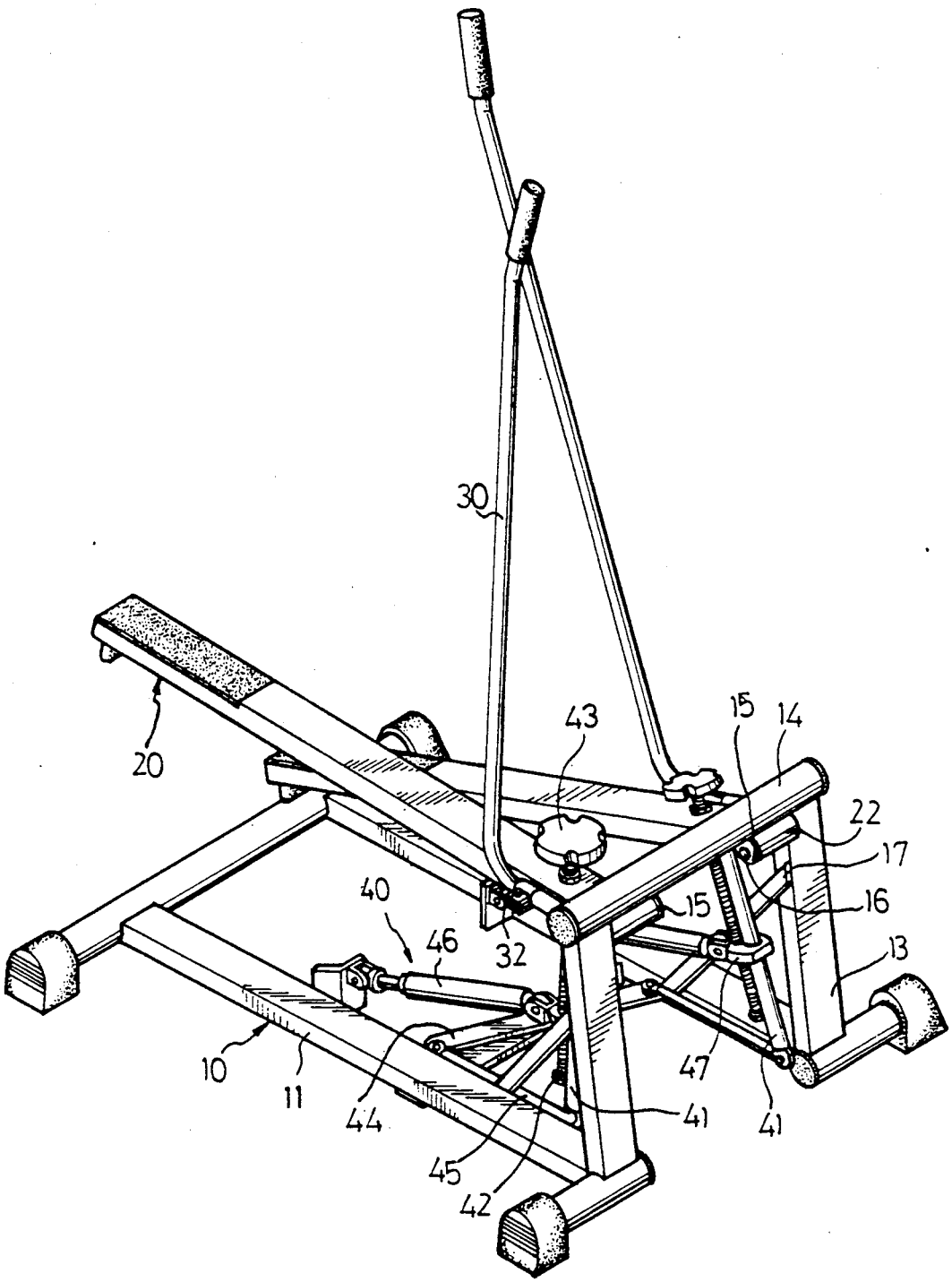
FIG. 1 is a perspective view of a stepping exerciser in accordance with the present invention.

Referring to the drawings and initially to FIG. 1, the stepping mechanism in accordance with the present invention comprises generally a frame body 10, a pair of treadles 20, a pair of handlebars 30 and an energy absorbing mechanism 40.

Figure 2:
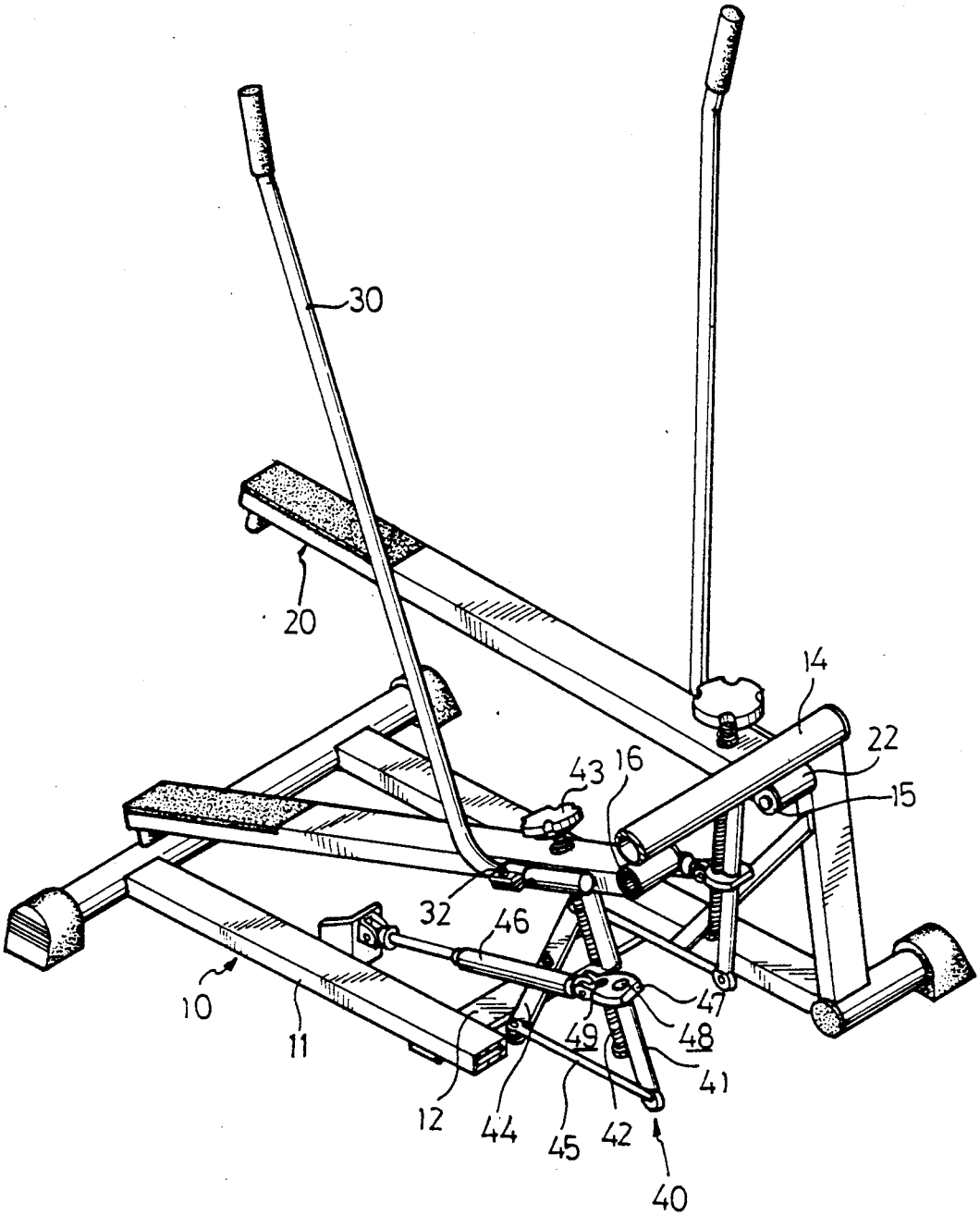
FIG. 2 is a perspective view similar to FIG. 1, in which part of the frame is removed for clearly illustrating purposes.
Figure 3:
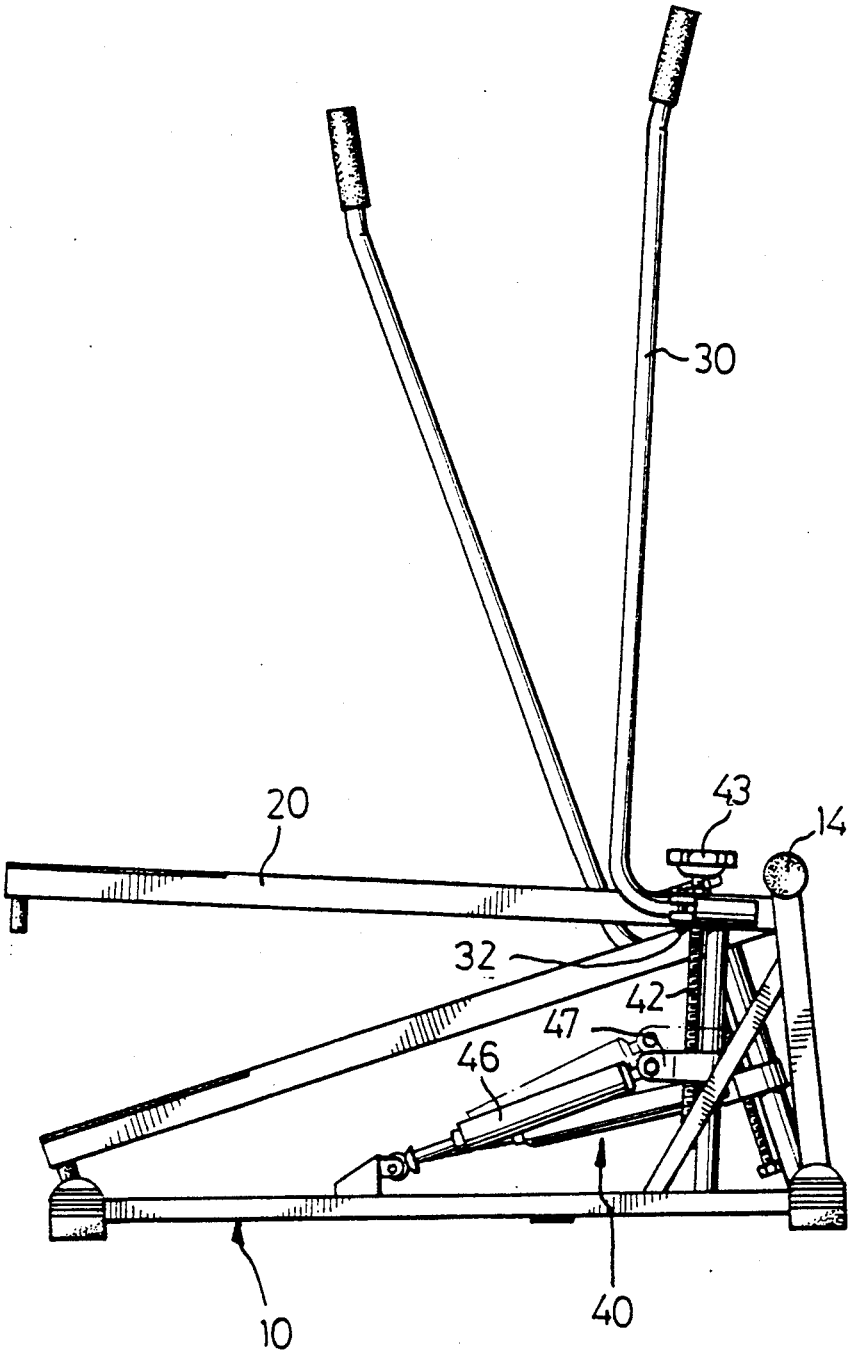
FIG. 3 is a plane view of the stepping exerciser.

Referring next to FIGS. 2 and 3, the frame body 10 has a base which includes a strip 12 laterally disposed between two parallel beams 11. A pair of posts 13 are vertically disposed at the front end of the beams 11. A bar 14 is laterally disposed between the top ends of the posts 13. Two pairs of ears 15 are disposed on the lower surface of the bar 14. A sleeve 22 is integrally fixed at the front end of each treadle 20 and is pivotally supported between a respective pair of ears 15 by a pivot axle 16. A pair of reinforcing plates 17 are fixed between the posts 13 and the beams 11 for reinforcement purposes. The lower ends of the handlebars 30 are fixed at the front ends of the treadles 20 on the outer sides thereof. The handlebars 30 are substantially vertical to the treadles 20.

The energy absorbing mechanism 40 includes a pair of rods 41 vertically fixed to the front and lower surfaces of the treadles 20. A bolt 42 is rotatably supported at the front end of each treadle 20 and is parallel to the rod 41. A knob 43 is fixed to the upper end of the bolt 42 which extends through the treadle 20. A middle portion of a lever 44 is pivoted on the strip 12 of the frame body 10. A pair of link rods 45 are pivotally connected between the ends of the lever 44 and the lower ends of the rods 41. The rear ends of a pair of cylinders 46, such as hydraulic cylinders, are fixed to the frame body 10. A lug 47 is pivoted to the front end of each cylinder 46. An opening 48 and a screw hole 49 are formed in each lug 47. The rod 41 is slidably received in the opening 48 of the lug 47 and the bolt 42 is threadedly engaged with the screw hold 49 of the lug 47 such that the cylinders 46 are substantially laterally provided between the frame body 10 and the rods 41. A rotation of the knobs 43 makes the lugs 47 move up and down along the respective bolts 42 so that the strength of the cylinders 46 can be adjusted.

When a user steps on the rear ends of the treadles 20 and his hands grip the handlebars 30, the user may do exercise which simulate stepping or climbing a ladder. As shown in FIG. 1, when the left treadle 20 is pressed downwards by the user and rotates downward about the pivot axle 16, the lower end of the rod 41 is caused to move forward; simultaneously, the lower end of the other rod 41 is caused to move rearward by the link rods 45 and the lever 44 such that the right treadle 20 is caused to rotate upwards. On the contrary, when the right treadle 20 is pressed downwards by the user, the left treadle 20 is caused to rotate upwards, as shown in FIG. 2.

Figure 4:
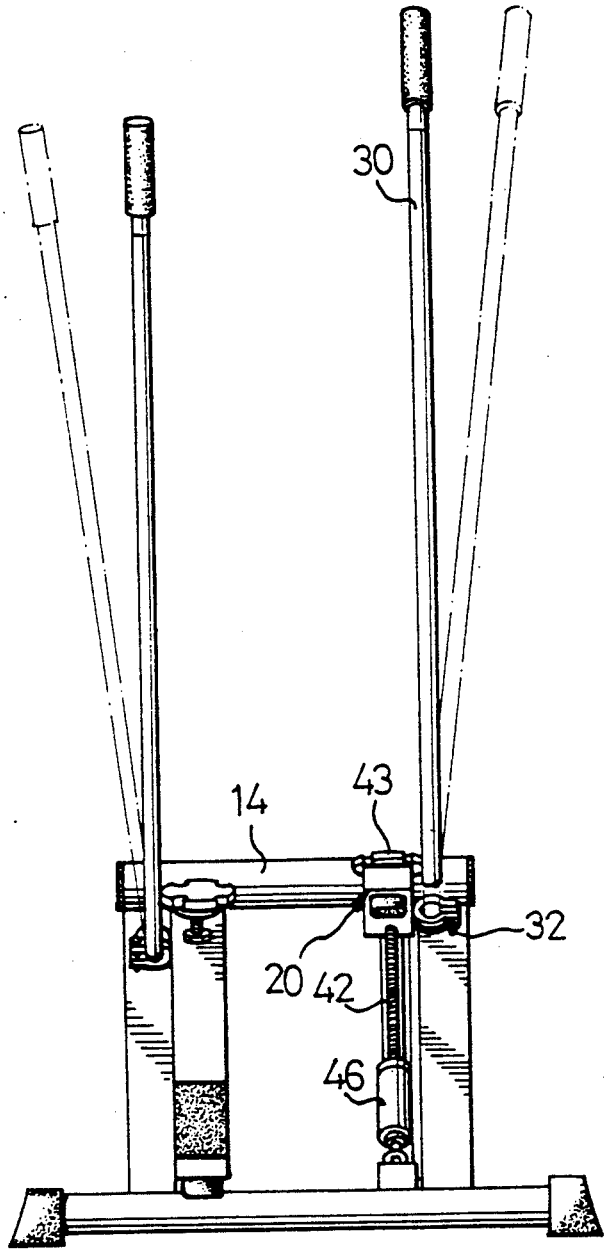
FIG. 4 is a rear end view of the stepping exerciser.

Referring next to FIG. 4, the coupling portions of the lower ends of the handlebars 30 to the treadles 20 can be released by unthreading the screws 32 so that the handlebars 30 can be adjusted or rotated either inwards or outwards to a suitable angle in accordance with the size of the users. The handlebars 30 are fixed at the desired angles by threading the screws 32 again.

Alternatively, the lugs 47 of the cylinders 46 are directly fixed to the rods 41 such that the strength of the cylinders 46 is fixed. In this case, the users may also do exercise which simulates stepping or climbing a ladder.

Accordingly, the stepping exerciser in accordance with the present invention may simulate stepping or climbing a ladder.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising a frame body; a pair of treadles, a front end thereof being pivoted to a front end of said frame body; a handlebar being substantially vertically coupled to said front end of each said treadle and extending upwards; a rod being fixed to said front end of each said treadle and extending downwards, a lower end of said rods being coupled together by a pair of link rods and a lever, a middle portion of said lever being pivoted to a base of said frame body; and a pair of hydraulic cylinders being substantially laterally coupled between said frame body and said rods; one of said treadles being rotated upwards when an other treadle is depressed downwards by a user so that said user may simulate stepping; a lug being pivotally coupled to a front end of each of said hydraulic cylinders, an opening and a screw hole being formed in each said lug, said rod being slidably received in said opening of said lug; a bolt being rotatably supported on said front end of each said treadle, said bolt being threadedly engaged with said screw hole of a respective lug; and a rotation of said bolt causing said lug to move up and down along said bolt so that the resistance of said hydraulic cylinders can be adjusted.

* * * * *